US006089613A

United States Patent [19]

Petkovsek

[11] Patent Number: 6,089,613

[45] **Date of Patent: *Jul. 18, 2000**

[54] LABEL AND/OR FORM FOR SPECIAL SERVICE MAILING AND A METHOD OF ASSEMBLING A MAILPIECE REQUIRING SPECIAL MAILING SERVICES

[76] Inventor: Glenn Petkovsek, 521 E. Markham Dr., Little Rock, Ak. 72201-1729

[ * ] Notice: This patent is subject to a terminal disclaimer.

[21] Appl. No.: 08/714,679

[22] Filed: Sep. 16, 1996

Related U.S. Application Data

[63] Continuation-in-part of application No. 08/281,634, Jul. 28, 1994, Pat. No. 5,573,277, which is a continuation-in-part of application No. 08/206,018, Mar. 4, 1994, abandoned.

[51] Int. Cl.[7] ..... B42D 15/00

[52] U.S. Cl. ..... 283/79; 229/70; 229/300; 283/81; 283/103; 462/6; 462/26

[58] Field of Search ..... 283/79, 81, 101, 283/103; 462/6, 26; 229/300, 70

[56] References Cited

U.S. PATENT DOCUMENTS

| | | | |
|---|---|---|---|
| 1,957,374 | 5/1934 | Unger . | |
| 2,074,821 | 3/1937 | Wissman . | |
| 2,270,455 | 1/1942 | Lichter . | |
| 2,279,164 | 4/1942 | Gettleman . | |
| 2,805,816 | 9/1957 | Morgan . | |
| 3,061,173 | 10/1962 | Sawdon . | |
| 3,164,317 | 1/1965 | Bogen . | |
| 3,813,028 | 5/1974 | Greason . | |
| 3,937,492 | 2/1976 | Biron . | |
| 3,968,927 | 7/1976 | Katz et al. . | |
| 3,986,662 | 10/1976 | Luftig . | |
| 4,368,903 | 1/1983 | Jones . | |
| 4,418,865 | 12/1983 | Bowen . | |
| 4,429,827 | 2/1984 | Murray . | |
| 4,682,793 | 7/1987 | Walz . | |
| 4,809,905 | 3/1989 | Goodman . | |
| 4,915,287 | 4/1990 | Volk et al. . | |
| 4,951,864 | 8/1990 | Dicker . | |
| 4,983,438 | 1/1991 | Jameson . | |
| 5,039,652 | 8/1991 | Doll et al. . | |
| 5,071,167 | 12/1991 | O'Brien . | |
| 5,183,203 | 2/1993 | Sanders . | |
| 5,190,210 | 3/1993 | Walz . | |
| 5,267,898 | 12/1993 | Doll et al. . | |
| 5,288,014 | 2/1994 | Meyers et al. . | |
| 5,316,208 | 5/1994 | Petkovsek . | |
| 5,383,686 | 1/1995 | Laurash . | |
| 5,413,383 | 5/1995 | Laurash et al. | 283/79 |
| 5,486,021 | 1/1996 | Laurash . | |
| 5,501,393 | 3/1996 | Walz . | |
| 5,507,526 | 4/1996 | Petkovsek . | |
| 5,547,227 | 8/1996 | Laurash et al. . | |
| 5,573,277 | 11/1996 | Petkovsek | 283/79 |
| 5,626,286 | 5/1997 | Petkovsek | 229/300 |
| 5,664,725 | 9/1997 | Walz . | |
| 5,836,622 | 11/1998 | Fabel | 283/62 |

FOREIGN PATENT DOCUMENTS

| | | |
|---|---|---|
| 1030577 | 5/1978 | Canada . |

OTHER PUBLICATIONS

U.S. Postal Service Certified Mailing Form PS 3811.

*Primary Examiner*—Andrea L. Pitts
*Assistant Examiner*—Monica Smith Carter
*Attorney, Agent, or Firm*—Patents & TMS, P.C.

[57] ABSTRACT

A label/form is provided for attaching portions thereof to a mailpiece or shipping item particularly for special service handling of the mailpiece or shipping item. Detachable parts are provided on a sheet for subsequent attachment to the mailpiece or shipping item following printing thereof. The label/form includes a number of adhesively-backed label sections and a return postcard section for selected attachment at selected areas of the mailpiece or shipping item to identify the mailpiece or shipping item and simplify the task of designating special services for a particular mailpiece or shipping item. The label/form is designed so that information unique to the mailpiece, such as the identifications of the sender and addressee and special handling requests, can be printed on one side of the label/form only.

25 Claims, 8 Drawing Sheets

LABEL AND/OR FORM FOR SPECIAL SERVICE MAILING AND A METHOD OF ASSEMBLING A MAILPIECE REQUIRING SPECIAL MAILING SERVICES

This application is a continuation-in-part of U.S. patent application Ser. No. 08/281,634 filed on Jul. 28, 1994, now U.S. Pat. No. 5,573,277, which is a continuation-in-part of U.S. patent application Ser. No. 08/206,018 filed on Mar. 4, 1994, now abandoned.

BACKGROUND OF THE INVENTION

The present invention generally relates to a form for printing address information relating to mail handling for attachment to a mailpiece. More specifically, the present invention relates to a multipart form for special service handling of mailpieces or for mailpieces requiring special services.

It is, of course, known to provide specialized postal processing and handling of particular mailpieces. Such special services include the preparation of certified mail, registered mail, insured mail, recorded delivery mail, return receipt for merchandise mail, C.O.D. and the like. The known procedure requires printing or writing of information on various slips of paper and attaching the slips to the outside of an envelope or other mailpiece. Often carbon paper is used to assist in making the attachments.

As an example, to prepare a certified mailpiece, the forms are supplied by the United States Postal Service to the customer. The customer must separately address and complete a certified mailing receipt, both faces of a return receipt card, an envelope or mailpiece in which the mail is to be mailed, and a request for return service on the face of the envelope. Then, the customer or the Postal Service must affix each of the completed parts to the envelope using glue, an adhesive, tape or the like.

In U.S. Pat. No. 4,682,793 to Walz, a multiple-part mailer form assembly is shown in which the addressing of the multiple forms required for certified mail or other specialized postal handling may be accomplished by continuously fed impact-type printers. The parts are then separated from each other for affixing some parts to the outside to a standard window envelope which can be addressed by the insertion of one of the extra form layers.

This type of multiple-layer continuous assembly cannot be addressed or overprinted in the non-impact printers as commonly used or on less expensive impact-type printers having no means to adjust for strength of impact or thickness of multiple-layer forms. Furthermore, the address information printed on the intermediate or rear layers of such forms is often degraded or blurred to a less readable condition by the necessity of printing through the multiple layers. This degradation renders the use of bar codes unfeasible on the lower layers of the address inserts to be compatible with U.S. Postal Service sorting equipment which is now generally used. Further, the degradation renders unfeasible the use of high-density bar codes in other formats for automated identification of the return receipt postal card when returned to the sender as proof of delivery to the addressee.

Still further, the multiple-part mailer disclosed by Walz requires forms to be separately affixed to the outside of the envelope or other mailpiece by using glue, adhesive, tape, or the like. The form includes a significant amount of carrier, backing, carbon layer, peel-off or other materials which require handling and removal during use and subsequent discarding as waste after use. Further, chemical treatment of some of the layers of the form is also required during manufacturing of the form.

Still further, the mailer disclosed by Walz is not suitable for feeding through automatic non-impact printers and, therefore, the return address of the sender must be printed on the back of the return receipt card portion of the form by non-impact means, i.e. either hand-printing or labeling or offset printing during the manufacturing process. This avoids unwanted reverse printing on the face of the other layers. Finally, the mailer of Walz does not disclose a means for noting the request for return receipt service, if desired, on the face of the envelope as required by postal regulations.

Clearly, the current methods known for-preparing mailpieces or shipping items for special services is tedious, complicated, and labor intensive, particularly for businesses and institutions in which items such as notifications, reminders, or valuable documents are commonly sent by specialized mail services. In many instances, the delivery of such mailpieces must be documented by recording of a U.S. Postal Service or other services return receipt when it arrives back to the sender. This task is also time-consuming and has great potential for error when all of the identifying information from each return receipt card must be entered or recorded by hand.

A need, therefore, exists for an improved form for special service mail and shipping handling and a method for assembling a mailpiece or shipping item requiring special services.

SUMMARY OF THE INVENTION

The present invention provides a label/form printed on two sides wherein portions of the label/form are attached to a sheet and including an adhesive on its back for attaching the same to a mailpiece or shipping item. Another portion of the sheet is detachable from the label/form for securing to the mailpiece and subsequent by design removal from the mailpiece or shipping item.

To this end, in an embodiment, the present invention provides a label/form for printing and addressing information relating to mail handling on a mailpiece. the label/form comprises a sheet and a plurality of detachable parts wherein at least of the plurality of detachable parts is removably secured to the sheet. An adhesive layer removably secures the at least one of the plurality of detachable parts to the sheet. An identifier on at least one of the plurality of detachable parts uniquely identifies the mailpiece.

In an embodiment, the identifier is a number. In another embodiment, the identifier is a bar code.

In an embodiment, the plurality of detachable parts comply with postal and shipping regulations for certified mail, registered mail, insured mail, recorded delivery mail and return receipt for merchandise mail, C.O.D. and shipping items.

In an embodiment, one of the plurality of detachable parts is a return receipt card, the return receipt card is laminated together with an adhesive layer tab on the right and left sides of the card.

In an embodiment, the information comprises at least a sending address and a return address.

In an embodiment, the sheet has a plurality of detachable parts for satisfying requirements for the mail and shipping handling of at least one or more mailpieces or shipping items.

In an embodiment, at least one or more parts of the plurality of detachable parts are provided for securing to the mailpiece or shipping item.

In an embodiment, the identifier has a background of a contrasting shade from at least a portion of the remainder of the plurality of detachable parts.

In another embodiment of the present invention, a two-sided special services mailing label/form for use on a mailpiece is provided. The label/form comprises a sheet having a first side and a second side, a first plurality of detachable parts on the first side secured to the first side by an adhesive.

In an embodiment, the two-sided special services mailing label/form further comprises an identifier on at least one of the detachable parts from the first plurality and the second plurality of detachable parts, the identifier uniquely identifying the mailpiece.

In an embodiment, the identifier is machine-readable.

In an embodiment, the first plurality of parts and the second plurality of parts satisfy requirements for mail handling of at least one or more mailpieces.

In an embodiment, the portion of the second plurality of detachable parts is a return receipt card.

In an embodiment, the sheet is printed having backgrounds of at least two contrasting shades.

In another embodiment of the present invention, a method is provided for assembling a mailpiece requiring special services for the mailpiece or shipping item. The method comprises the steps of: providing a label/form printed on at least one or more sides of the sheet, the label/form having a plurality of detachable parts; removing a first part of the plurality of detachable parts from the sheet, the first part having an adhesive back for removable attachment to the sheet and subsequent attachment to the mailpiece or shipping item, the first part identifying a type of special service; attaching the first part to the mailpiece or shipping item; removing a second part of a plurality of detachable parts from the sheet, the second part having a portion thereof adhesively-backed for attachment to the mailpiece or shipping item and attaching the second part to the mailpiece or shipping item.

In an embodiment, the method further comprises the step of providing an identifier on at least the first part and the second part, the identifier uniquely identifying the mailpiece or shipping item. In an embodiment, the identifier is machine-readable.

In an embodiment, the method further comprises the steps of removing a third part of the plurality of detachable parts from the sheet, the third part having an adhesive backing for removable attachment to the sheet and subsequent attachment to the mailpiece or shipping item; and attaching the third part to the mailpiece or shipping item. In an embodiment, the third part includes information relating to delivery of the mailpiece or shipping item.

In an embodiment, a portion of the second part forms a return receipt card. In an embodiment, the second part is removed from the sheet by tearing at a perforated tear line.

In an embodiment, the method further comprises the step of printing the label/form with at least two contrasting background colors.

In another embodiment of the present invention, a mailpiece or shipping item is provided requiring special services for handling thereof. The mailpiece or shipping item comprises a first adhesively-backed section for attachment to the mailpiece or shipping item having a designation indicative of the special service. A partially adhesively-backed section attaches to the mailpiece or shipping item having a perforated tear line for removal of the non-adhesively-backed portion of the section from the mailpiece or shipping item.

In an embodiment, a second adhesively-backed section attaches to the mailpiece or shipping item.

In an embodiment, an identifier on the first adhesively-backed section and the partially adhesively-backed section is provided wherein the identifier uniquely identifies the mailpiece or shipping item.

It is, therefore, an advantage of the present invention to provide a label/form and a method for simplified assembly of a mailpiece or shipping item requiring special services.

Another advantage of the present invention is to provide a label/form and a method for identifying the type of special service by removal of a portion of the label/form from a sheet and subsequent attachment to a mailpiece or shipping item.

Yet another advantage of the present invention is to provide a label/form and a method for assembly of a mailpiece or shipping item requiring special services such that the label/form and the method-can be quickly performed.

A still further advantage of the present invention is to provide a label/form and a method for assembling a mailpiece or shipping item using the label/form without requiring additional means for securing the label/form to the mailpiece or shipping item.

And, another advantage of the present invention is to provide a label/form that simplifies identification of particular sections thereof for both machine readability and visible identification.

The present invention also provides a label/form that comprises a sheet having a front side and a back side. While both the front side and back side of the sheet include printed form information, only the front side of the sheet includes pre-printed information regarding the shipment, handling, delivery and identification of the article that is unique to the article. Hence, after the form/label is mass produced, it can be prepared for use on an article by printing information relating to the article on the front side of the label/form only.

The sheet that comprises the form is divided into a plurality of detachable label sections and a detachable card section. The back side of the sheet comprises an adhesive layer that is laterally displaced from the card section so that the back sides of the detachable label sections carry an adhesive layer for attaching the label sections to the article. Preferably, the sheet also comprises at least one detachable adhesive section disposed adjacent to and detachably connected to the card section so that the card section may be removably attached to the article.

In an embodiment, the label/form further comprises an identifier disposed on at least one of the label sections for uniquely identifying the article.

In an embodiment, the card section of the label/form includes an identifier for uniquely identifying the article.

In an embodiment, the back side of the label/form is covered with a removable backing to protect the adhesive layer.

In an embodiment, at least one label section of the label/form is attached to the card section and provides return address information for the card section.

In an embodiment, at least one label section of the label/form is attached to the card section and provides information relating to the shipment and handling of the article so that the card section and label section providing shipment and handling information for the article may be attached to the article together.

In an embodiment, at least one label section which provides a receipt for the sender of the article is attached to the card section so that the card section and the label section providing a return receipt for the article may be attached to the article together.

In an embodiment, the front sides of the plurality of label sections and the front side of the card section are printed with information relating to the shipment and handling of the article.

In an embodiment, the label/form further comprises two detachable adhesive sections disposed adjacent to opposing ends of the card section for enabling the card section to be removably attached to the article.

In an embodiment, the identifier is a number. In another embodiment, the identifier is a bar code. In yet another embodiment, the identifier is machine-readable.

In an embodiment, the plurality of detachable labels and card section comply with postal and shipping regulations for certified mail, registered mail, insured mail, recorded delivery mail and return receipt for merchandise mail, C.O.D. and shipping items.

In an embodiment, the information comprises at least a sending address and a return address.

In an embodiment, the sheet has a plurality of detachable parts for satisfying requirements for the mail and shipping handling of at least one or more mailpieces or shipping items.

In an embodiment, the identifier has a background of a contrasting shade from at least a portion of the remainder of the plurality of detachable parts.

In another embodiment, the present invention comprises an article for mailing or shipment requiring special services. The article comprises a sheet having a front side and a back side. While both the front side and back side of the sheet are pre-printed forms, only the front side of the sheet is printed with information unique to the article to be mailed. The sheet also comprises a plurality of detachable label sections laterally displaced from one another. The label sections receive and display information unique to the article. The sheet also comprises a detachable card section that is laterally displaced from the label sections. The back side of the sheet also comprises an adhesive layer laterally displaced from the card section for attaching the label sections to the article. Preferably, the sheet also includes at least one adhesive section disposed adjacent to and removably connected to the card section for removably attaching the card section to the article.

In an embodiment, at least one label section is disposed adjacent to and connected to the card section. The label section disposed adjacent to and connected to the card section provides sender return address information for the back side of the card section and may be folded over and onto the back side of the card section.

In an embodiment, at least one label section is attached to the card section which provides information relating to the shipment and handling of the article. If the article to be mailed is an envelope, the card section and the label section may be simultaneously attached to the envelope by attaching the card section to the backside of the envelope and folding the label section over and onto the front side of the envelope.

In an embodiment, at least one label section is attached to the card section which provides a receipt for the sender of the article. In an embodiment, where the article to be mailed is an envelope or other thin article, the card section may be attached to the back side of the envelope or thin article and the receipt section may be folded over and attached to the front side of the envelope.

In another embodiment, the present invention provides an improved method for assembling an article for mailing or shipment requiring special services. The method comprises the steps of: providing a label/form printed on both sides of a sheet but with printing specific to the article on only one side of the sheet wherein the label/form has a detachable card section and a plurality of detachable label sections, at least one label section providing return address information for the card section and at least one label section providing shipment and handling information for the article; removing the card section and the label sections from the sheet; attaching the label section having return address information for the card section to the card section; and, thereafter attaching the card section and the label section providing shipment and handling information to the article.

In an embodiment, the method further comprises the step of providing an identifier on at least one label section which uniquely identifies the article.

In an embodiment, the card section is attached to the label section providing return address information for the card section.

In an embodiment, the card section is attached to the label section providing shipment and handling information to the article whereby the card section and the label section providing shipment and handling information to the article are simultaneously attached to the article.

In an embodiment, the method further comprises the steps of removing a third detachable label from the sheet, the third detachable label including information relating to the delivery of the article and thereafter attaching the third detachable label to the article.

It is, therefore, an advantage of the present invention to provide a label/form and a method for simplified assembly of a mailpiece or shipping item requiring special services.

Another advantage of the present invention is to provide a label/form and a method for identifying the type of special service by removal of a portion of the label/form from a sheet and subsequent attachment to a mailpiece or shipping item.

Yet another advantage of the present invention is to provide a label/form and a method for assembly of a mailpiece or shipping item requiring special services such that the label/form and the method can be quickly performed.

A still further advantage of the present invention is to provide a label/form and a method for assembling a mailpiece or shipping item using the label/form without requiring additional means for securing the label/form to the mailpiece or shipping item.

Another advantage of the present invention is to provide a label/form that simplifies identification of particular sections thereof for both machine readability and visible identification.

And, another advantage of the present invention is to provide a label/form for use on mailpieces or shipping items requiring special services that includes printing unique to the mailpiece or shipping item on only one side of the label/form.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
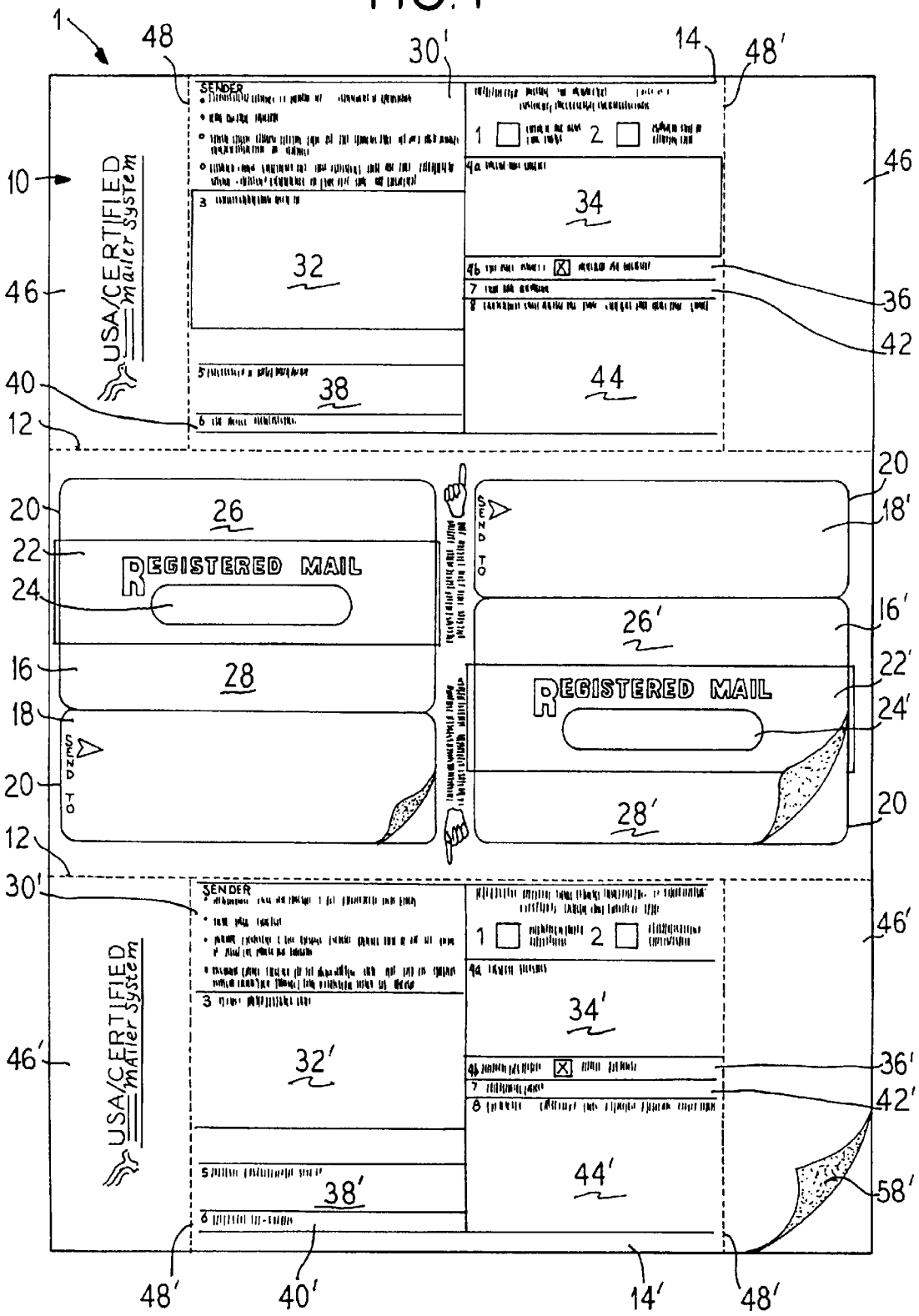
FIG. 1 illustrates a plan view of an embodiment of one side of a label/form for special service mailing/shipping of a mailpiece or shipping item.

Referring now to the drawings, wherein like numerals refer to like parts, a special service mailing label/form is generally illustrated at 1. The label/form 1 consists of a plurality of detachable parts. Some of the parts of the label/form 1 are detachable by tear lines, while other portions of the label/form 1 are attached to the sheet by an adhesive on the back of the portion.

FIG. 1 illustrates a first side 1 of the label/form 1. The first side 10 has two sets of detachable parts for satisfying requirements for mailing/shipping of at least one mailpiece or shipping item requiring special services. It should be understood, however, that a particular label/form may be infinite in length satisfying the requirements for any number of mailpieces or shipping items requiring special services. In the alternative, the label/form may be designed such that it satisfies requirements for labeling and special services for a single mailpiece or shipping item. Still further, the label/form illustrated is for registered mail, however, any type of special service mailing or shipping may be satisfied with the present invention, including, but not limited to, registered mail, insured mail, recorded delivery, return receipt for merchandise, C.O.D., etc.

The label/form 1 illustrated in FIG. 1 has the two horizontal perforated tear lines 12 for removal of return receipt card sections 14 and 14' from the remainder of the label/form 1. A second set of parts are adhesively-backed to the label/form 1 for removable attachment to the label/form 1 and subsequent attachment to the mailpiece or shipping item. Service identifier sections 16 and 16' are attached to the label/form 1 by an adhesive backing. Sender identifier sections 18 and 18' are similarly adhesively-backed to the label/form 1. The service identifier sections 16 and 16' and the sender identifier sections 18 and 18' have score lines 20 generally defining each of the sections and for simplified removal of the sections 16, 16', 18 and 18' from the label/form 1.

The service identifier sections 16 and 16' include a first special service identifier 22 and 22', respectively. The special service identifiers 22, 22' may be distinctly colored from the remainder of the service identifier sections 16, 16'. Still further, letters may be imprinted on the service identifier sections 16, 16' indicating the particular type of special service, such as the "REGISTERED MAIL" identifier.

Contrasting colored sections 24, 24' are provided within the special service identifiers 22, 22' of the service identifier sections 16, 16'. The contrasting colored sections 24, 24' may be printed with an identifier such as an article number and/or may be further printed with variable specific instructions as "RETURN RECEIPT REQUESTED" or other imprinting as desired.

Figure 4:
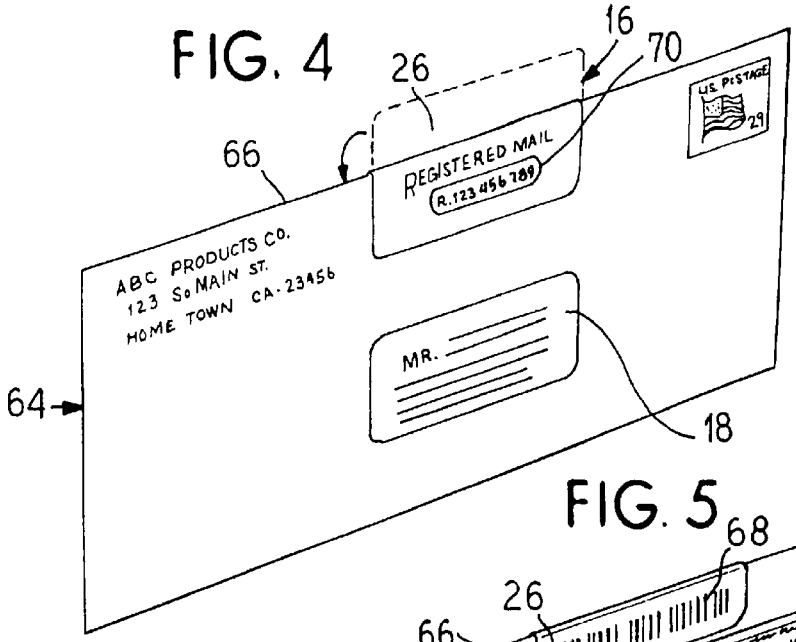
FIG. 4 illustrates a perspective view of an embodiment of one side of a mailpiece or shipping item with attachment of a portion of the label/form required for special service mail or shipment handling of the mailpiece or shipping item.

Top sections 26, 26' and bottom sections 28, 28' are provided on opposite sides of the special service identifiers 22, 22' for additional space for printing in label/formation as desired or, alternatively, may be left unprinted or blank. The top sections 26, 26' are particularly suitable for printing of bar codes, OCR type or other machine-readable images. The top sections 26, 26' are inverted when sealed onto the mailpiece or shipping item (as illustrated in FIG. 4) such that a back side of the mailpiece or shipping item includes the identifier associated with the mailpiece or shipping item.

The return receipt card sections 14, 14' on the first side 10 of the label/form 1 are removably attached to the label/form 1 by the perforated tear lines 12. The return receipt card sections 14, 14' include instruction sections 30, 30', article addressee sections 32, 32', article number or identifier sections 34, 34', service type sections 36, 36', addressee signature sections 38, 38', and agent signature sections 40, 40'. Further, date of delivery sections 42, 42' and addressee's address sections 44, 44' are provided. This particular label/form is suitable for a return receipt card for registered mail and other special service mail and shipping items. Of course, similar type receipt cards capable of providing a return receipt following delivery of the mailpiece or shipping item may be implemented.

Any one or more of the aforementioned sections may be of contrasting color to the main background color of the remainder of the label/form 1. For instance, typically, the background color of the return receipt card sections 14, 14' may be a green shade commonly used for return receipt cards. The identifier sections 34, 34' may have a white background for simplified reading of, for example, a bar code or OCR characters printed thereon. Likewise, the article addressee sections 32,32' may be printer with a white background for immediate recognition on the label/form 1 of the delivery point of the mailpiece or shipping item carrying the label/form 1. The central portion of the label/form 1 including the service identifier sections 16,16' and the sender identifier sections 18,18' may be similarly shaded with contrasting colors for identification and machine readability purposes of the bar codes and/or OCR characters or the like.

Figure 5:
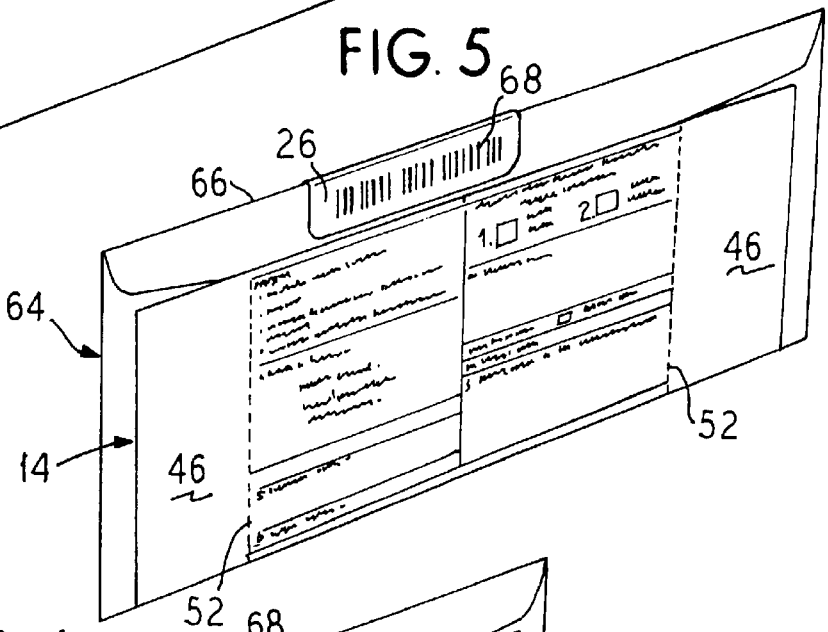
FIG. 5 illustrates a plan view of an embodiment of a second side of a mailpiece or shipping item with a second portion of the label/form required for special service handling of the mailpiece or shipment attached to the mailpiece or shipping item.

Peelable sections 46 and 46' are provided a silicone layer 56' and an adhesive layer 58' for removably detaching the back side of the label/form 1 from the return receipt card and subsequent attachment to the mailpiece or shipping item as illustrated in FIG. 5. To this end, that portion of the return receipt card sections 14, 14' on the first side 10 of the label/form 1 is attached in its entirety to the mailpiece or shipping item. Vertical perforated lines 52, 52' are provided for subsequent detachment of the return receipt card from the mailpiece or shipping item (as illustrated in FIG. 6).

Figure 2:
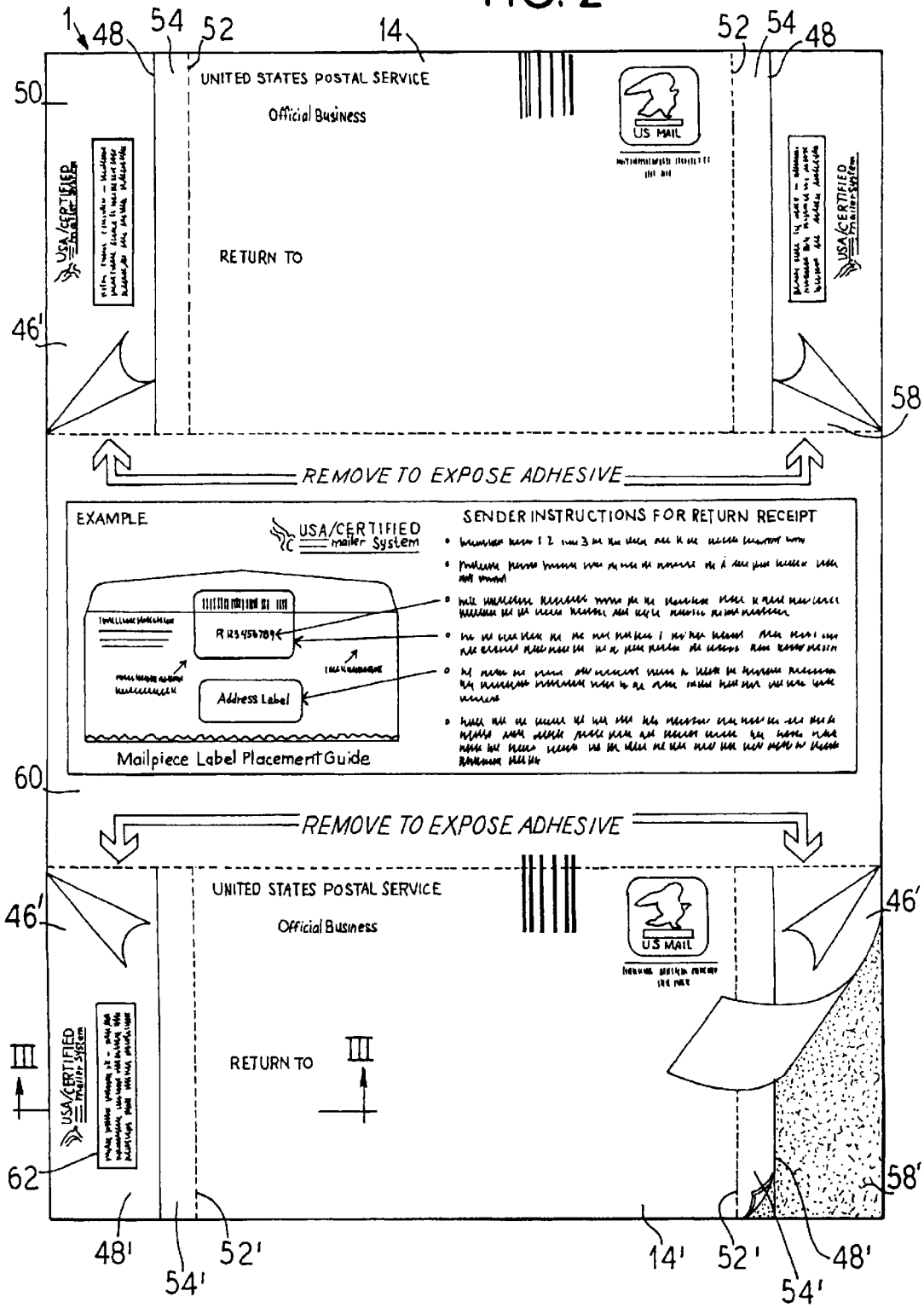
FIG. 2 illustrates a plan view of an embodiment of a second side of a label/form for special service mailing/shipping of a mailpiece or shipping item.
Figure 3:
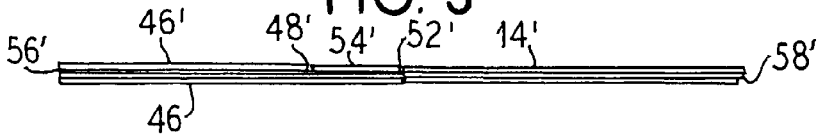
FIG. 3 illustrates a partial cross-sectional view taken generally along the line III—III of FIG. 2.

Referring now to FIG. 2, a back side 50 of the label/form 1 is illustrated. The back side 50 includes front faces of the return receipt card sections 14, 14'. The vertical perforated tear lines 52, 52' are further provided inside of vertical slit lines 48, 48'. The area between the vertical slit lines 48, 48' and the vertical perforated tear lines 52, 52' define tying together sections 54, 54'. The tying together sections 54, 54' include an area having a back having a partial section thereof containing the adhesive layer 58, 58' as illustrated in FIGS. 2 and 3. That is, the adhesive layer 58, 58' from the peelable sections 46, 46' continues into the tying together sections 54, 54' for securing the return receipt card sections 14, 14' thereto.

The adhesive layers 58, 58' are provided to prevent separation of the layers of the return receipt card label/forming the front side and the back side thereof. A central section 60 is provided on the back side 50 including instructions for assembling the label/form onto the mailpiece or shipping item. Additional instructions may be provided on the peelable sections 46, 461 as generally illustrated at 62.

Figure 6:
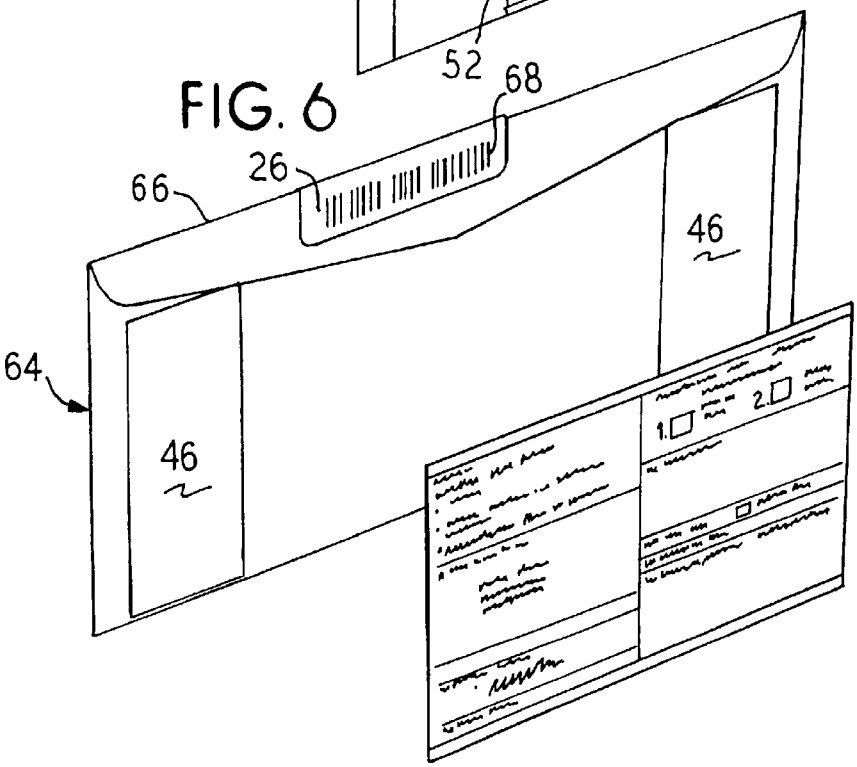
FIG. 6 illustrates a perspective view of an embodiment of a second side of the mailpiece or shipping item with a portion of the second part of the label/form detached from the mailpiece or shipping item.

The assembling of a mailpiece or shipping item 64 with the respective portions of the label/form 1 is more clearly illustrated in FIGS. 4–6. To assemble the mailpiece or shipping item 64, a sender identifier section 18 is first removed from the first side 10 of the label/form 1 and centered onto the mailpiece or shipping item 64. Then, following printing of the requisite information onto each of the individual sections, the service identifier section 16 is attached at a top edge 66 of the mailpiece or shipping item 64. The section of the service identifier section 16 referred to as the top section 26 is inverted to face on the back side of the mailpiece or shipping item 64 as illustrated in FIGS. 5 and 6. The top section 26 may include a machine readable identifier 68 corresponding to the numerical identifier 70 on a front side of the mailpiece or shipping item 64. Then, the return receipt card section 14 may be attached to a back side of the mailpiece or shipping item 64 by removing the peelable sections 46 such that the adhesive layer 58, 58' on the underside of the sections 46 is placed on the back side of the mailpiece or shipping item 64. As a result, the return receipt card section 14 is attached to the back side of the mailpiece of shipping item 64.

Following delivery of the mailpiece or shipping item 64, the return receipt card of the return receipt card section 14 may be detached along the vertical perforated tear lines 52 separating the return receipt card from the remainder of the mailpiece or shipping item 64. The peelable sections 46 maintain their adhesion to the back side of the mailpiece or shipping item 64 as shown in FIG. 6.

Figure 7:
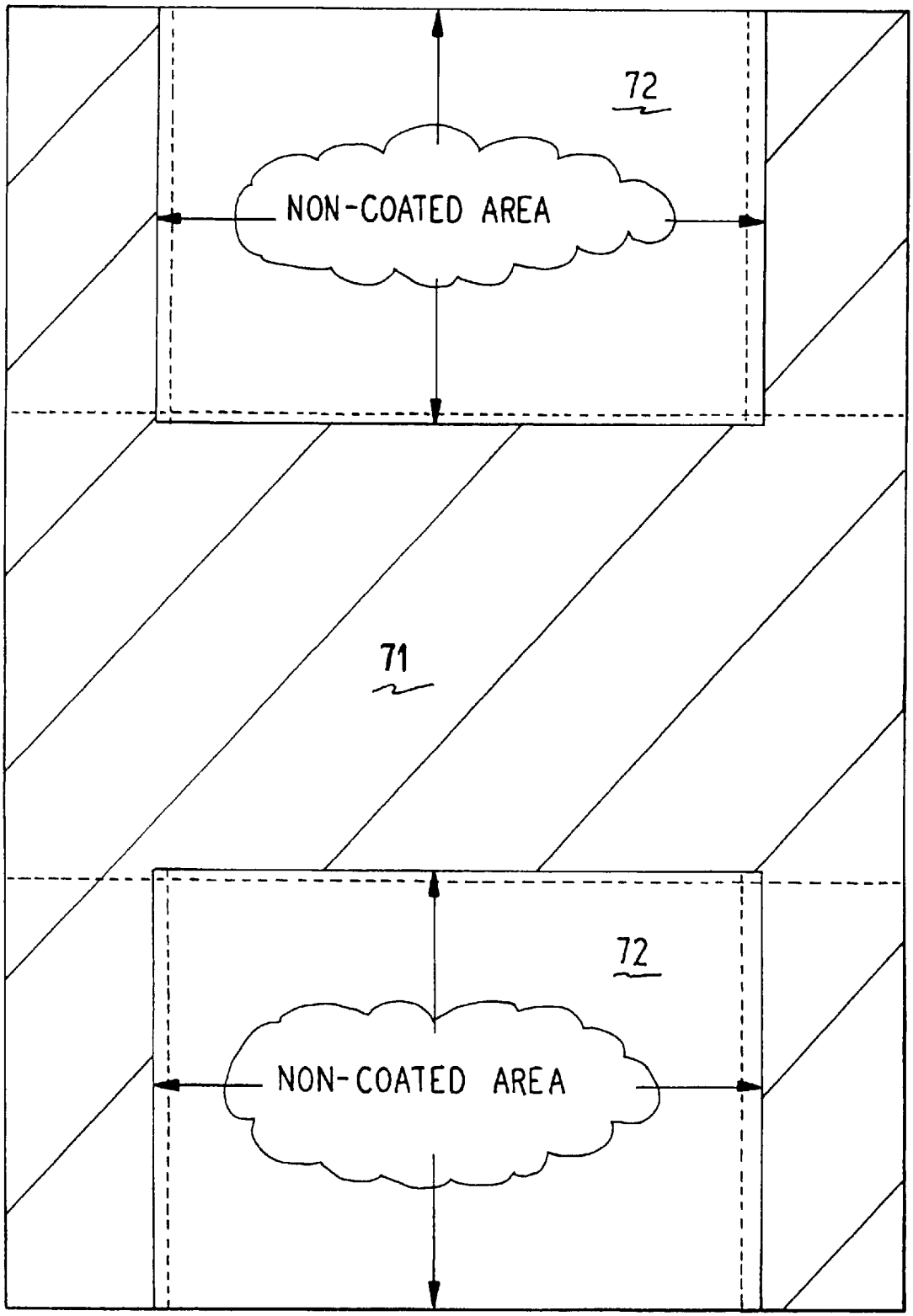
FIG. 7 illustrates a plan view of the label/form of the present invention designating the areas of the label/form having coated and non-coated areas of adhesive.

As illustrated in FIG. 7, the area generally designated at 70 includes the silicone layer 56 or 56' and the adhesive layer 58 or 58', respectively, providing the necessary peelability of layers of the label/form 1. The non-coated areas generally designated at 72 include only the adhesive layer preventing peelability between the layers label/formed by the front side and the back side of the label/form 1 resulting in label/formation of the return receipt card 14. The combination of the adhesive layer 58 with the silicone layer 56 also prevents or inhibits migration of the adhesive layer 58 along edges, perforations, and/or slits of the label/form 1.

In yet another alternative embodiment, the label/form 110 consists of a plurality of detachable parts. The parts of the label/form 110 are detachable by tear lines, score lines, perforations or the like.

Figure 8:
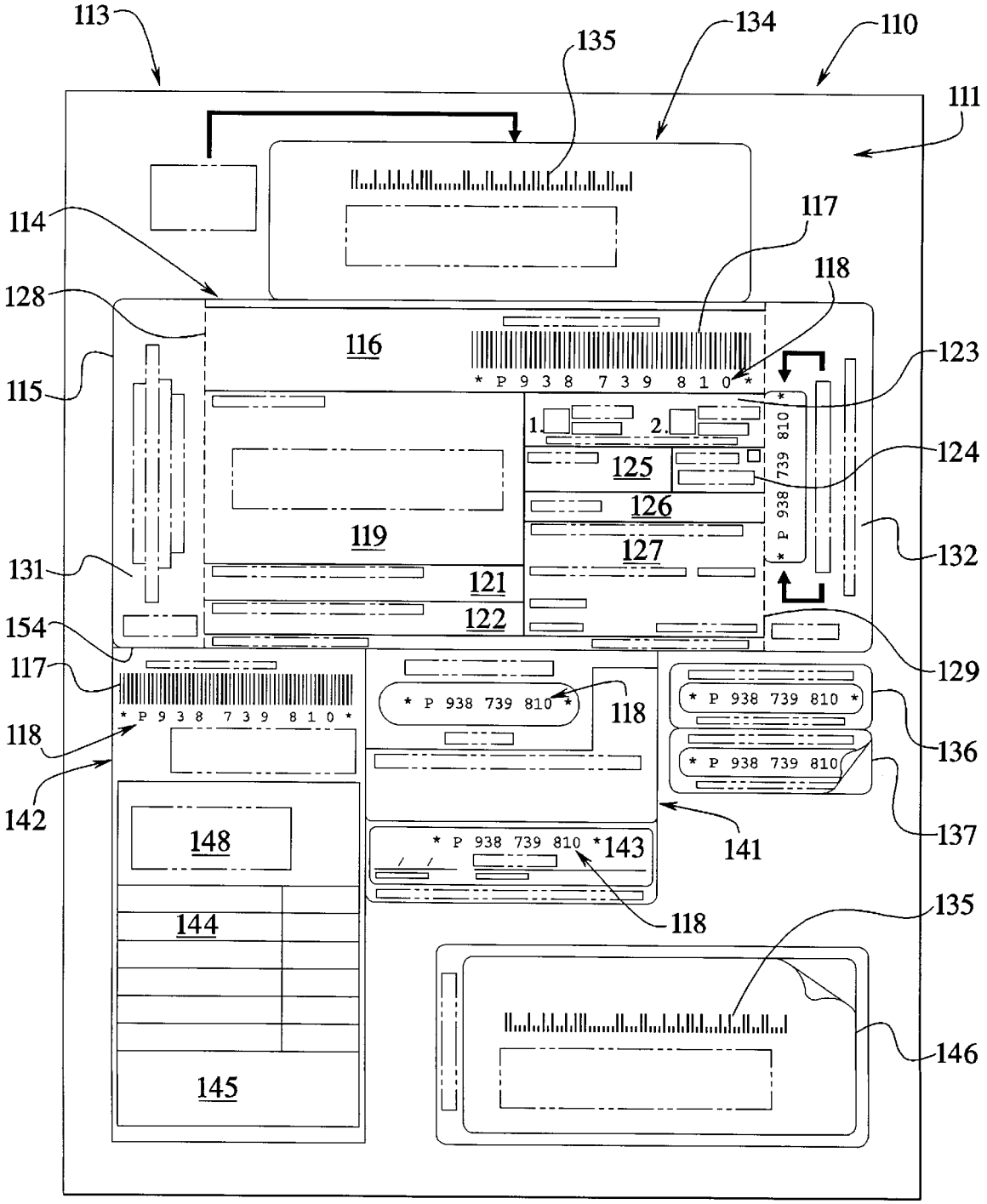
FIG. 8 illustrates a plan view of an embodiment of a front side of a label/form for special service mailing/shipping of a mailpiece or shipping item.
Figure 9:
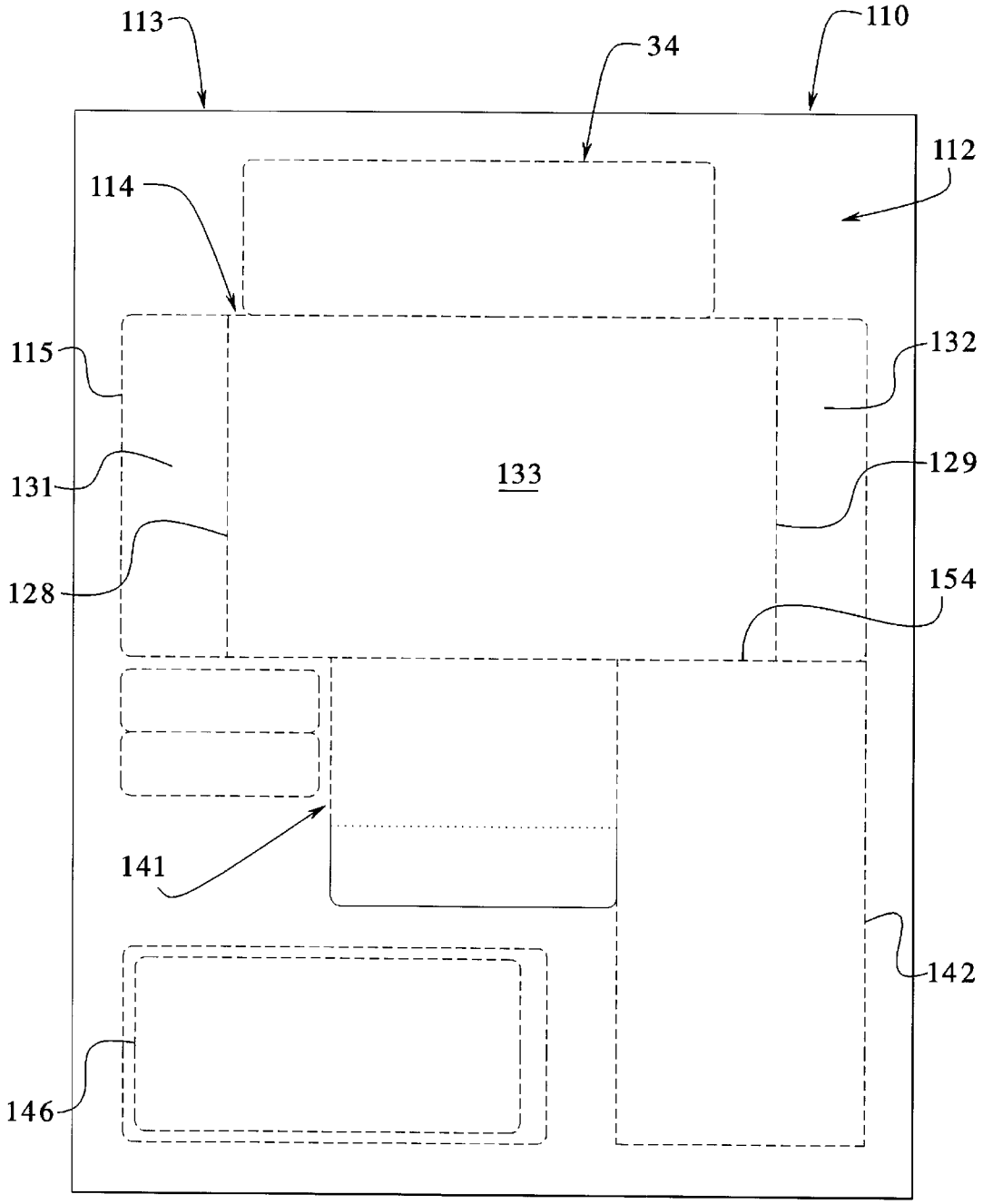
FIG. 9 illustrates a plan view of an embodiment of a back side of a label/form for special service mailing/shipping of a mailpiece or shipping item.

FIG. 8 illustrates a first or a front side 111 of the label/form 110. FIG. 9 illustrates a second or back side 112 of the label form 110. For purposes of clarity, the side 111 will hereinafter be referred to as the front side 111, and the side 112 will hereinafter be referred to as the back side 112.

As illustrated in FIG. 8, the front side 111 has one set of detachable parts for satisfying requirements for the mailing/shipping of at least one mailpiece or shipping item requiring special services. It should be understood, however, that a particular label/form may be infinite in length satisfying the requirements for any number of mailpieces or shipping items requiring special services. In the alternative, the label/form may be designed such that it satisfies requirements for labeling and special services for a single mailpiece or shipping item. Still further, the label/form illustrated is for registered mail; however, any type of special service mailing or shipping may be satisfied with the present invention, including, but not limited to, registered mail, insured mail, recorded delivery, return receipt for merchandise, C.O.D., etc.

The label/form 110 illustrated in FIGS. 8 and 9 comprises a sheet 113 with a plurality of detachable parts that are defined by tear lines, score lines or perforations' that extend through the sheet 113, or through the front side 111 to the back side 112 as illustrated in FIGS. 8 and 9. As illustrated in FIG. 8, a return postcard is shown at 114. While the front side 111 of the label/form 110 is illustrated in FIG. 8, the actual back side of the postcard 114 is disposed in the front side of the label/form 110 because it is the back side of a return postcard, such as the one shown at 114 in FIG. 8, that requires the most amount of information specific to the particular article. In order to provide a label/form 110 which requires printing on one side only, such as the front side 111, it is necessary to dispose the back side of the postcard 114 upward so that it may be printed with the appropriate information relevant to the article being shipped, the sender and the addressee.

Therefore, the postcard 114 includes an article identification section 116 which may include a bar code 117, a number 118 or other suitable means for uniquely identifying the article being shipped. An addressee identification section is provided at 119 on which the name and address of the addressee is pre-printed. A receiver identification section 121 and a receiver signature section 122 are provided to record the name and signature of the person acknowledging receipt of the article.

Additional informational sections are provided to the right of sections 119, 121 and 122 for varying purposes. For example, a special services request section 123 may be provided for requesting special services such as locating the addressee's address or restricting delivery. A service request section 124 may be provided for requesting special services such as certified delivery. An additional article identification section may be provided at 125. A delivery date section may be provided at 126. An address identification request section may be provided at 127 for recording the addressee's address if such a service is provided.

The return postcard 114 includes two perforated score lines 128, 129 which separate the postcard 114 from the two adhesive sections 131, 132. The two adhesive sections 131, 132 enable the postcard 114 to be removably attached to the article to be mailed because, as illustrated in FIG. 9, the entire back side 112 of the label/form 110 is coated with adhesive with the exception of the back side 133 of the postcard 114. Thus, the two adhesive sections 131, 132 may be affixed to the article to be mailed, and the postcard 114 may be detached from the adhesive sections 131, 132 and the article to be mailed by tearing along the tear lines 128, 129.

Also illustrated in FIG. 8 is the sender ID section or label 134 which is pre-printed with the sender's address. The label 134 is then folded over and onto the back side 133 of the postcard 114. By providing the sender's address label 134 at the front side 111 of the label/form 110, the label 134 may be pre-printed with the other components of the label/form 110 shown in FIG. 8 thereby eliminating any need for pre-printing any component shown on the back side 112 in FIG. 9. Accordingly, all of the information specific to the article being mailed is printed on the front side 111 of the label/form 110 which eliminates the need for any two-sided printing. Accordingly, a preferred embodiment will include a removable backing layer (not shown) which covers the back side 112 of the label/form 110 to protect the adhesive layer.

As illustrated in FIG. 8, the sender address label 134 may also include a bar code 135 or other identification means. Additional article identification labels may be provided at 136, 137.

In addition to the sender address label 134 which is preferably attached to the return postcard section 114, a service identification label 141 and a receipt label 142 are also disposed adjacent to, and preferably connected to, the return postcard 114. The service identification label 141 preferably includes a specification of the type of service required (e.g., certified mail) in addition to the article identification number 118 or other article identification means. In addition to the number 118, a bar code may be provided in the label 141. Optionally, a sender identification section may be provided at 143 which again may optionally include the article identification number 118. The receipt label 142 also preferably includes the article identification number 118, the bar code 117 or other suitable identification means. The receipt 142 may also provide an addressee identification section 148, a fee calculation section 144 and a space 145 for indicating the postmark or postage date.

Also illustrated in FIG. 8 is the addressee label section 146. The addressee label section 146 may also include a bar code 135 or other similar identification means.

In a preferred embodiment, the sender address label 134, the return postcard 114 as attached to the adhesive sections 131, 132, the service ID label 141 and the receipt label 142 are all detachably connected together as illustrated in FIG. 8. In use, the addressee identification label 146 is removed from the sheet 113 and attached to the front side 153 of the envelope 151. Then, the sender address label 134 , the postcard section 114 and adhesive sections 131, 132, the service identification label 141 and the receipt label 142 are all pulled off of the sheet 113 as a single piece. The sender address label 134 is then folded over and onto the front side 133 of the postcard 114 as illustrated in FIGS. 9 and 11.

Figure 10:
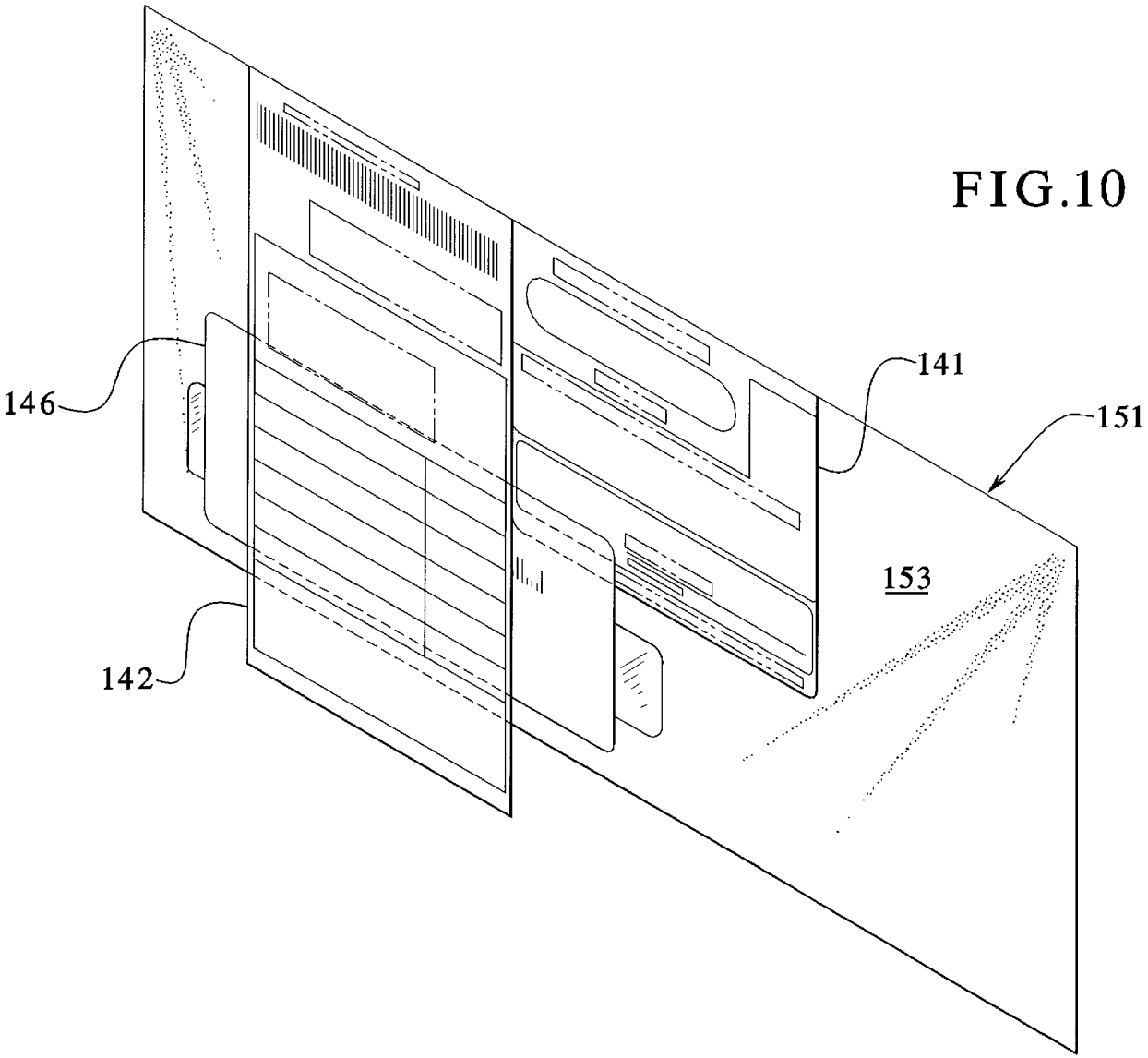
FIG. 10 illustrates a perspective view of an embodiment of a front or address side of a mailpiece or shipping item with attachment of a portion of the label/form required for special service mail or shipment handling of the mailpiece or shipping item.
Figure 11:
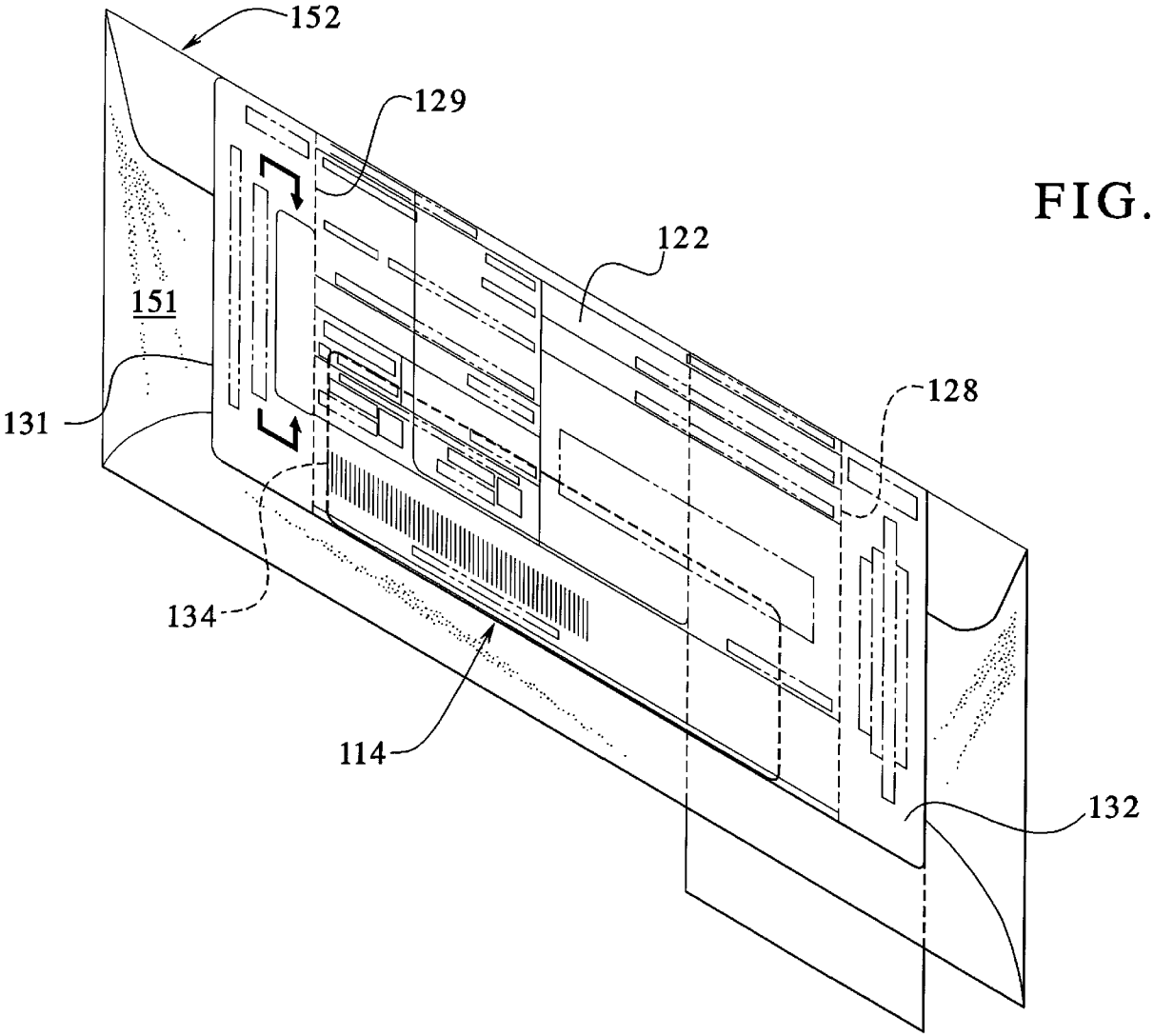
FIG. 11 illustrates a plan view of an embodiment of a back side of a mailpiece or shipping item with a second portion of the label/form required for special service handling of the mailpiece or shipping item.

Still referring to FIG. 11, the return postcard section 114 and the adhesive sections 131, 132 are then attached to a back side 151 of the article to be mailed 152, which, as illustrated in FIGS. 10 and 11, may be an envelope. Then, as illustrated in FIG. 10, the receipt label 142 and the service identification label 141 are then folded over and onto the front side 153 of the envelope 151. After the receipt 142 has been filled out and postmarked, it can be easily removed by pulling it off of the envelope 151 and tearing it along the score line shown at 154 in FIGS. 8 and 9.

After the envelope 152 has been shipped to the addressee, and the addressee or a representative has acknowledged receipt by signing in the signature space 122, the postcard 114 can be removed from the envelope 152 by tearing along the perforated lines 128, 129. With the sender return address label 134 in place on the front side 133 of the postcard 114 as illustrated in FIGS. 9 and 11, the postcard 114 is then ready to be mailed. It will be noted that the front side 133 of the postcard 114 should be preprinted with a first-class mail permit number and a return address listing the United States Postal Service as the return addressee.

Of course this particular arrangement is suitable for many types of mailpiece or shipping items requiring special service and for a variety of mailpiece or shipping items requiring special service mailing. Therefore, the present invention is not to be construed or limited to registered mail on a standard size envelope as illustrated in FIGS. 10 and 11, but should rather encompass any type of mailpiece or shipping item requiring any type of special service, particular those requiring a return receipt or other acknowledgment of receipt of the mailpiece or shipping item. Specifically, in a preferred embodiment, the card 114, label 141 and receipt 142 are all easily detached from one another for use on a larger package such as a box or carton.

Furthermore, printing of the label/form may be conducted in any known manner, such as by hand, by feeding the sheet through a printer, or by a continuously fed printer either an impact or non-impact type. The present invention is not to be limited in the manner in which the label/form itself is printed as the same may be implemented by those skilled in the art.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A label/form for receiving and displaying of information relating to shipment and handling of an article for delivery by a special service, the label/form comprising:

a sheet comprising a front side and a back side, information relating to shipment and handling unique to the article is printed on the front side of the sheet only and not the back side of the sheet, the sheet further has a plurality of detachable label sections laterally displaced from one another wherein at least one of the plurality of labels includes an identifier indicative of the special service the sheet also having a detachable card section laterally displaced from the label sections and further wherein the plurality of label sections is removably attached to the detachable card section via tear lines and further wherein the back side of the plurality of label sections on the sheet include an adhesive layer laterally displaced from the card section for attaching at least one of the plurality of label sections and the card section to the article wherein the detachable card section is a return receipt postcard and further wherein a back side of the detachable card section includes no adhesive and further wherein the detachable card section includes the identifier indicative of the special service corresponding to the identifier on the at least one of the plurality of labels.

2. The label/form of claim 1 further comprising:

an identifier disposed on at least one of the plurality of label sections and the card section uniquely identifying the article.

3. The label/form of claim 2 wherein the identifier is disposed on the front side of the sheet only.

4. The label/form of claim 1 further comprising:

a removable backing removably attached to the back side of the sheet.

5. The label/form of claim 1 wherein at least one of the plurality of label sections for providing return address information for the card section is attached to the card section.

6. The label/form of claim 1 wherein at least one of the plurality of label sections for providing information relating to shipment and handling for the article is attached to the card section.

7. The label/form of claim 1 wherein at least one of the plurality of label sections for providing a receipt for the sender of the article is attached to the card section.

8. The label/form of claim 1 wherein the plurality of label sections are pre-printed with information relating to shipment and handling of the article.

9. The label/form of claim 1 further comprising:

at least one detachable adhesive section disposed adjacent to the card section, the detachable adhesive section enabling the card section to be removably attached to the article.

10. The label/form of claim 1 further comprising:

two detachable adhesive sections disposed adjacent to the card section at opposing ends thereof, the detachable adhesive sections enabling the card section to be removably attached to the article.

11. The label/form of claim 1 wherein the identifier has a background of a contrasting shade from at least a portion of a remainder of the plurality of detachable label sections.

12. A method for assembling an article for mailing or shipment requiring delivery by a special service for the article, the method comprising the steps of:

providing a label/form, printed on both sides of a sheet but with printing specific to the article on only one side of the sheet, the label/form comprising a detachable card section and a plurality of detachable label sections wherein the plurality of label sections is removably attached to the detachable card section via tear lines and further wherein at least one of the plurality of label sections provides return address information for the card section and further wherein at least one of the plurality of label sections provides shipment and handling information for the article and further wherein the at least one of the plurality of labels includes an identifier indicative of the special service wherein the detachable card section is a return receipt postcard and further wherein a back side of the detachable card section includes no adhesive and further wherein the detachable card section includes an identifier indicative of the special service corresponding to the identifier on the at least one of the plurality of labels;

removing the card section and the plurality of label sections from the sheet, the card section and the plurality of label sections having back sides that are adhesively-backed for attachment to the article wherein at least one of the plurality of label sections provides return address information for the card section and includes a back side having an adhesive for attachment to the card section and further wherein at least one of the plurality of label sections provides shipment and handling information and includes a back side having an adhesive for attachment to the article;

attaching one of the plurality of label sections providing return address information for the card section to the card section;

attaching the card section to the article; and attaching one of the plurality of label sections providing shipment and handling information to the article.

13. The method of claim 12 further comprising the step of:

attaching the card section providing return address information for the card section to the label section.

14. The method of claim 12 further comprising the step of:

attaching the card section to one of the plurality of label sections providing shipment and handling information for the article.

15. The method of claim 12 further comprising the step of:

providing an identifier on at least the one of the plurality of label sections, the identifier uniquely identifying the article.

16. The method of claim 12 further comprising the steps of:

removing a third detachable label section from the sheet, the third label section having an adhesive backing for attachment to the article, the third label section providing information relating to delivery of the article; and attaching the third label section to the article.

17. The method of claim 12 further comprising the step of:

printing the label/form with at least two contrasting background shades.

18. An article for mailing or shipment requiring delivery by a special service, the article comprising:

a sheet having a front side and a back side, the sheet having a plurality of detachable label sections laterally displaced from one another for receiving and displaying information on front sides of the plurality of detachable label sections and further wherein at least one of the plurality of labels includes an identifier indicative of the special service and further having a detachable card section laterally displaced from the label sections and further wherein the plurality of label sections is removably attached to the detachable card section via tear lines and further wherein the detachable card section is a return receipt postcard including an identifier indicative of the special service corresponding to the identifier on the at least one of the plurality of labels and further including information relating to shipment and handling unique to the article that is preprinted on the front side of the sheet only wherein the back side of the sheet has an adhesive layer laterally displaced from the card section for attaching the plurality of label sections to the article, the back side also having at least one adhesive section disposed adjacent to and removably connected to the card section for removably attaching the card section to the article wherein a back side of the detachable card section includes no adhesive.

19. The article of claim 18 wherein at least one of the plurality of label sections attached to the card section provides sender return address information for the back side of the card section.

20. The article of claim 18 wherein at least one of the plurality of label sections is attached to the card section for providing information relating to shipment and handling of the article.

21. The article of claim 18 further comprising:

an envelope wherein one of the plurality of label sections provides shipment and handling information attached to a front side of the envelope and further wherein the card section is attached to a back side of the envelope.

22. The article of claim 18 wherein at least one of the plurality of label sections is attached to the card section for providing a receipt for the sender of the article.

23. The article of claim 22 further comprising:

an envelope wherein one of the plurality of label sections provides a receipt attached to a front side of the envelope and further wherein the card section is attached to a back side of the envelope.

24. The article of claim 18 further comprising:

an identifier on at least one of the plurality of label sections and the card section for uniquely identifying the article.

25. The article of claim 18 wherein the plurality of label sections are pre-printed with information relating to shipment and handling of the article.

* * * * *